United States Patent [19]

Topping

[11] Patent Number: 4,870,766

[45] Date of Patent: Oct. 3, 1989

[54] PICTURE SUPPORT

[76] Inventor: Irene M. Topping, 78 Kenilworth Road, Overport, Durban Natal Province, South Africa

[21] Appl. No.: 134,246

[22] Filed: Dec. 17, 1987

[30] Foreign Application Priority Data

Dec. 19, 1986 [ZA] South Africa ..... 86/9581
Jan. 12, 1987 [ZA] South Africa ..... 87/0181

[51] Int. Cl.[4] ..... G09F 1/12
[52] U.S. Cl. ..... 40/154
[58] Field of Search ..... 40/154, 155; 229/176, 229/177; 248/472

[56] References Cited

U.S. PATENT DOCUMENTS 1,323,086 11/1919 Moore ..... 40/154
2,144,594 1/1939 Katz ..... 40/154
3,214,855 11/1965 Winkler et al. ..... 40/154
3,286,387 11/1966 Poertner ..... 40/154

FOREIGN PATENT DOCUMENTS 2382152 10/1978 France ..... 40/155
634295 3/1950 United Kingdom ..... 40/155
1459696 12/1976 United Kingdom ..... 40/154

*Primary Examiner*—Robert P. Swiatek
*Assistant Examiner*—Cary E. Stone
*Attorney, Agent, or Firm*—Michael N. Meller

[57] ABSTRACT

The invention relates to a picture support for hanging a picture on a wall, which includes a cardboard blank that can be folded to form a box-like construction. Opposing flaps of the blank, that permit it to be folded into its required box-like construction, define opposing tongue formations and slits that can engage one another and hold the blank in its folded configuration. The blank can further have a picture directly or indirectly applied to a central portion thereof and, when folded, can be suspended from a wall to give the impression of a box-like picture support, supporting the picture.

14 Claims, 4 Drawing Sheets

PICTURE SUPPORT

This invention relates to a picture support for hanging a picture on a wall.

According to the invention there is provided a picture support for hanging a picture on a wall, which includes a cardboard sheet element defining an angular picture supporting central portion onto which a picture can be applied, and flaps projecting from the sides of the central portion, that are folded to provide the support with a box-like construction, the flaps having holding means for holding the picture support in its box-like construction configuration.

The sheet element may particularly be of a suitable cardboard material that permits folding to provide for the required box-like construction. Furthermore, the angular picture supporting central portion of the sheet element may preferably be square or rectangular.

Further according to the invention, the picture supporting central portion of the sheet element may have a picture directly applied thereto, for which configuration the picture may be directly printed onto the said central portion. Alternatively, the picture supporting central portion may have a picture indirectly applied thereto. As such, the picture supporting central portion may have a picture, already applied onto a sheet element such as paper, adhered thereto.

According to one specific embodiment of the invention, the flaps projecting from each side of the central portion of the sheet element may define first flap portions extending directly from the central portion and that are folded to be disposed at right angles to the central portion and thereby provide the support with apparent thickness and its box-like construction;

second flap portions that are folded to extend back to the operative rear face of the central portion and are angularly disposed with resepct to the first flap portions; and third flap portions that are folded to abut the operative rear face of the central portion and are adhered thereto, the flaps being suitably cut away to overcome interference with one another while co-operating to enhance the rigidity of the support.

Further according to this embodiment of the invention, two opposing first flap portions may have extensions extending therefrom that are folded to overlap with adjacent first flap portions in the defined configuration of the picture support.

Still further according to this embodiment of the invention, the holding means may be an adhesive and, more specifically, the third flap portions may have a suitable adhesive applied thereto for adhering these flap portions to the central portion in the operative configuration of the picture support. The said adhesive applied to the sheet element of the picture support may be in the form of a suitable double sided adhesive tape.

According to a second specific embodiment of the invention, the flaps projecting from each side of the central portion of the sheet element may define first flap portions extending directly from the central portion and that are folded to be disposed at right angles to the central portion and thereby provide the support with apparent thickness and its box-like construction;

second flap portions that are folded to project towards one another in a configuration in which they are disposed parallel to the central portion of the sheet element and perpendicular to the first flap portions;

third flap portions that are folded towards the operative rear face of the central portion to be disposed perpendicularly to the second flap portions and the central portion; and fourth flap portions that are folded to project towards the outer perimeter of the central portion, being in abutment with the operative rear face of the central portion, said four flaps being suitably cut away to overcome interference with one another while co-operating to enhance the rigidity of the picture support.

Further according to this embodiment of the invention, the holding means may be engagement formations defined by the flaps, whereby opposing flaps may engage one another for holding the picture support in its box-like construction configuration.

The engagement formations defined by the flaps may particularly include projecting tongue formations, projecting from edges of predetermined flaps, and slits, defined by other flaps, that can be engaged by the tongue formations by being disposed opposite to the flaps defining the projecting tongue formations. For the configuration of the picture support in which the central portion is square or rectangular, the projecting tongue formations may extend from opposite ends of the third flap portions of two opposing flaps, and the slits may be formed within the third flap portions of the other two opposing flaps. Alternatively, the projecting tongue formations may extend from opposite ends of the second flap portions of two opposing flaps, and the slits may be formed within the second flap portions of the other two opposing flaps, opposite the said tongue formations. The engagement formations may also include both sets of tongue formations and slits, as defined.

Still further according to this latter embodiment of the invention, the flaps may have additional flap portions extending therefrom that can be folded to overlap with other flap portions in order to enhance the overall rigidity of the picture support in its operative configuration. Also according to this further embodiment of the invention, the holding means may additionally include an adhesive applied to predetermined flap portions, permitting these flap portions to adhere to other flap portions or the central portion of the picture support, for enhancing the rigidity of the picture support.

In general, the picture support of the invention may have been formed of a planar cardboard blank being suitably cut-away to define the central portion and the flaps projecting therefrom. This blank may further have fold lines that can facilitate folding of the flaps into their required configuration.

Still further, the central portion of the sheet element may have poster pictures applied directly thereto. Also, the picture support may include hanging means for hanging the picture support onto a wall. The hanging means may include an aperture formed within a flap, that can engage a suspension means such as a nail extending from a support wall.

The invention also extends to a blank for a picture support that can be folded into the configuration of a picture support in accordance with the present invention.

Still further, the invention extends to a poster including a poster picture applied to a sheet element, that can be folded into the form of a picture support in accordance with the present invention.

The invention is now described, by way of examples, with reference to the accompanying diagrammatic drawings, in which.

Figure 1:
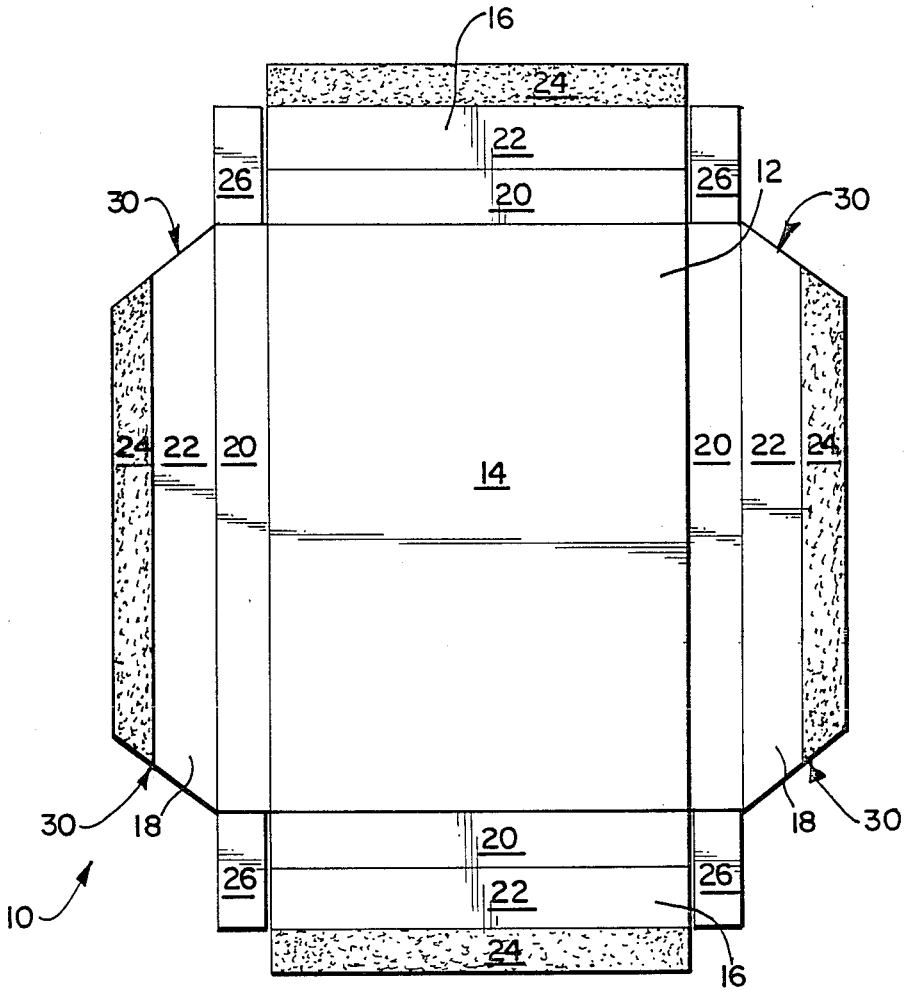
FIG. 1 shows a cardboard sheet element blank for forming a first embodiment of a picture support, in accordance with the invention.
Figure 2:
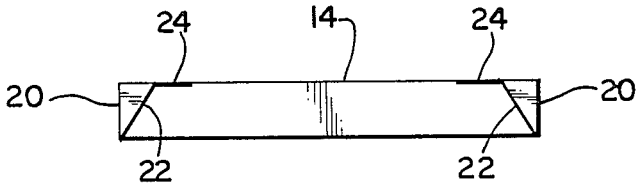
FIG. 2 shows a cross-sectional end view of the sheet element of FIG. 1, folded into its operative configuration.

Referring initially to FIGS. 1 and 2 of the drawings, a blank for a picture support, in accordance with the invention, is generally indicated by the reference numeral 10. The blank 10 comprises a cardboard sheet element 12, the sheet element 12 defining a rectangular picture supporting central portion 14 and two opposing pairs of flaps, 16 and 18 respectively, projecting from opposite sides of the central portion 14.

Each flap 16 and 18 includes a first flap portion 20, that can be folded to be disposed at right angles to the central portion and thereby provide a picture support with apparent thickness and a box-like construction, a second flap portion 22, that can be folded to extend back to the operative rear face of the central portion and be angularly disposed with respect to the first flap portion 20, and a third flap portion 24, that can be folded to abut the operative rear face of the central portion and be adhered thereto. The flaps 18 further include extension portions 26 that extend from opposite ends of their first flap portions 20, the flaps and the individual flap portions as defined above being clearly defined by fold lines that are pre-formed within the blank 10 and that can facilitate folding thereof into the form of a picture support.

FIG. 2 shows a cross-sectional end view of the blank 10 in its operative configuration in which it defines a picture support, the configuration of the flaps 18 in their operative configuration being clearly illustrated. In particular, the flap portions 20 are disposed at right angles to the central portion 14, whereas the flap portions 22 are folded back towards the operative rear face of the central portion 14. The flap portions 24 then abut this rear face of the central portion. These portions 24 are adhered to the rear face of the central portion 14 and in this way provide the picture support with its required rigidity and stability. Adhesion of the flap portions 24 to the portions 14 may be by means of an adhesive but, preferably, the blank may be provided with double sided adhesive tape having one side adhered to the flap portions 24, so that the opposite side thereof can be adhered to the rear face of the central portion 14 of the sheet element 12, as illustrated.

In this operative configuration of the picture support as illustrated in FIG. 2, the flap portions 26, extending from the flap portions 20 of the flaps 18, overlap with the flap portions 20 of the flaps 16 and effectively close-off the corners of the box-like construction defined by the picture support. The flaps 18 are further cut-away as shown in order to accommodate the flaps 16 in their operative configuration, the angular edges 30 bearing against the flaps 16 in this operative configuration to thereby add to the rigidity and stability of the picture support.

Figure 3:
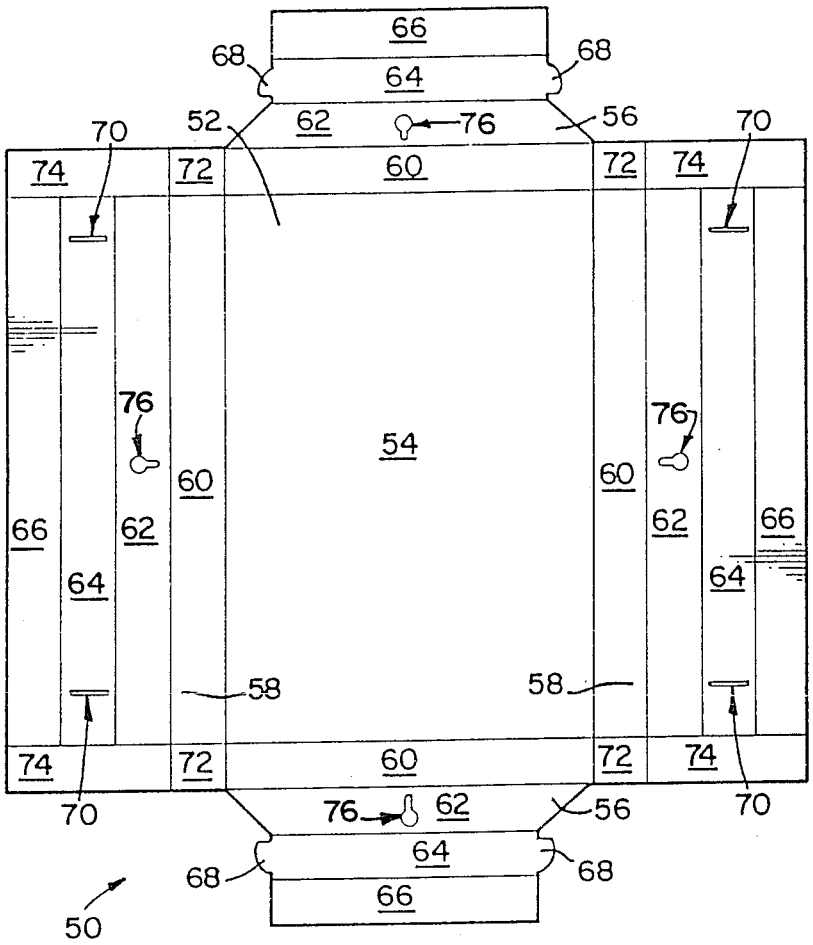
FIG. 3 shows a cardboard sheet element blank for forming a second embodiment of a picture support, in accordance with the invention.
Figure 4:
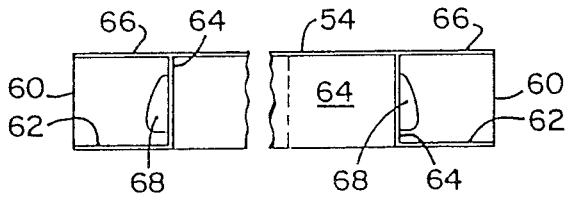
FIG. 4 shows a cross-sectional end view of the sheet element of FIG. 1, folded into its operative configuration.

Referring now to FIGS. 3 and 4 of the drawings, a blank for a second embodiment of a picture support, in accordance with the invention, is generally indicated by the reference numeral 50. The blank 50 comprises a planar cardboard sheet element 52, defining a rectangular picture supporting central portion 54 and two opposing pairs of flaps, 56 and 58 respectively, projecting from opposite sides of the central portion 54.

Each flap 56 and 58 includes a first flap portion 60, that can be folded to be disposed at right angles to the central portion 54 and thereby provide a picture support with apparent thickness and a box-like construction. Each flap 56 and 58 further includes a second flap portion 62, extending from the first flap portion 60, which flap portions 62 can be folded to project towards one another and be disposed perpendicular to the first flap portions 60 and parallel to the central portion 14, and a third flap portion 64 that can be folded to project towards the operative rear face of the central portion 54.

The flaps 56 and 58 further include fourth flap portions 66, projecting from the third flap portions 64, that can be folded to project perpendicular to the third flap portions 64 in their operative configuration to project towards the outer perimeter of the central portion 54, abutting the operative rear face of this central portion 54. This folded configuration of the flaps is particularly illustrated in FIG. 4 which shows clearly the foled configuration of the flaps 58.

The flap portions 64 of the flaps 56 further define two projecting tongue formations 68 that project from opposite ends thereof and that can engage slits 70 defined in the third flap portions 64 of the flaps 58, with the picture support folded into its operative configuration as is clearly illustrated in FIG. 4. The tongue formations 68 and slits 70 are particularly positioned so that they engage one another as a result of the folding of the blank 12 into its operative picture support configuration.

Additional flap portions 72 and 74 are defined by the flaps 58, these flap portions being folded to overlap with other flap portions of the respective flaps, in order to provide additional rigidity to the picture support in its operative configuration.

As is clear from FIG. 3 of the drawings, the flaps are suitably cut-away and formed so that they accommodate one another in their operative configuration, while co-operating with one another to enhance the rigidity and stability of the picture support.

It is anticipated that the picture support will hold itself in its operative configuration via the mere engagement of the tongue formations 68 with the slits 70 and that no additional means will be required for holding a picture support in its operative configuration. However, it is anticipated that a suitable adhesive, or like means may be provided whereby the flaps 56 and 58 can be held in their operative configuration, such as an adhesive particularly being used in situations where it is not anticipated for the picture support to be unfolded from time to time. However, it is clearly not essential to use an adhesive for the purpose above described.

Figure 5:
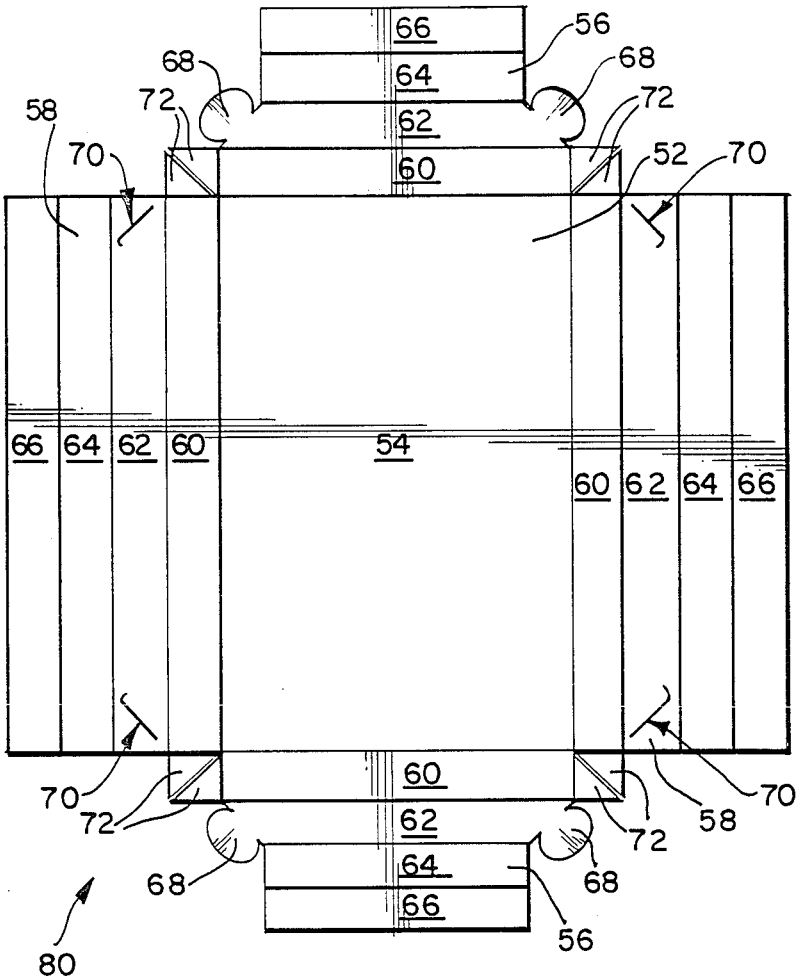
FIG. 5 shows a cardboard sheet element blank for forming a third embodiment of a picture support, in accordance with the invention.

Referring now to FIG. 5 of the drawings, the blank for a picture support, in accordance with a third embodiment of the invention, is generally indicated by the reference numeral 80. This blank and the resulting picture support that can be formed therefrom is similar to the blank 50, except for the shape and location of the engagement formations, and like portions of the blank 80 is therefore indicated by the same reference numerals as used in respect of the blank 50 as illustrated in FIG. 3. This blank 80 therefore again includes a sheet element 52 defining a central portion 54 and flaps 56 and 58 respectively. The flaps 56 and 58 again define flap portions 60, 62, 64 and 66 respectively, the general configuration of these flaps being essentially similar to that of the flaps described above with reference to FIG. 3.

However, for this configuration of the blank 80, the flap portions 62 of the flaps 16 define two projecting tongue formations 68 that project from opposite ends thereof and that can engage slits 70 defined in the second flap portions 62 of the flaps 58, with the picture support folded into its operative configuration (not shown). The tongue formations 68 and slits 70 are particularly positioned so that they engage one another as a result of the folding of the blank 80 into its operative picture support configuration.

Also, for this embodiment of the blank 80, additional flap portions 72 are defined by the flaps 56 and 58, these flap portions 72 extending from the flap portions 60 of the respective flaps and being formed to fold over to overlap with one another in the operative folded configuration of the blank, to provide the resulting picture support with additional rigidity.

As is clear from FIG. 5, the flaps are suitably cut away and formed so that they accommodate one another to enhance the rigidity and stability of the picture support. It is once again anticipated that a picture support formed of a blank 80 will hold itself in its operative configuration via the mere engagement of the tongue formations 68 with the slit 70 and that no additional means will be required for holding the picture support in its operative configuration. However, it is again anticipated that a suitable adhesive, or like means, may be provided whereby the flaps 56 and 58 can be held in their operative configuration, such an adhesive again only being utilised when it is not anticipated that the picture support will ever need to be unfolded.

In general referring now to picture supports that can be formed of all the blanks 10, 50 and 80 respectively, it is anticipated that a picture can be directly applied to the operative outer or exposed side of the central portion 14, 54 of the respective blanks, by printing, or a like process, and when used in conjunction with poster pictures, or the like, blanks can be provided as posters that can be folded to define the required box-like construction which, it is believed, will be attractive when suspended on walls, or the like.

In order to facilitate suspension, apertures may be provided in predetermined flap portions of the flaps of the blanks, which apertures may be selectively engaged by a nail, or other suspension means projecting from a wall, for the suspension of the picture support. The blank 50 illustrated in FIG. 3 illustrates the possible location of apertures 76 whereby a picture support can be suspended as proposed. Clearly, alternative means may also be provided for this purpose.

Furthermore, picture supports formed of blanks as above described can have separate pictures applied thereto, which pictures may again be poster pictures, or any other pictures as may be desired. It is believed that such picture supports will be attractive in use and separate picture frames or supports will therefore no longer be an essential requirement for the hanging of pictures onto walls.

In practice, pictures can be provided as part of picture supports, folded into their operative configuration, or, alternatively, as blanks that can be subsequently folded into their picture support configuration in which they can be suspended from a wall.

It will be understood that the specific configuration of blanks for pictures supports can vary significantly and the invention extends also to such alternative configurations of blanks and picture supports that include the principles of the present invention. More particularly, the configuration of the flaps and engagement formations may vary significantly and it is also anticipated that the tongue formations and slits as described above can be used in combination.

Figure 6:
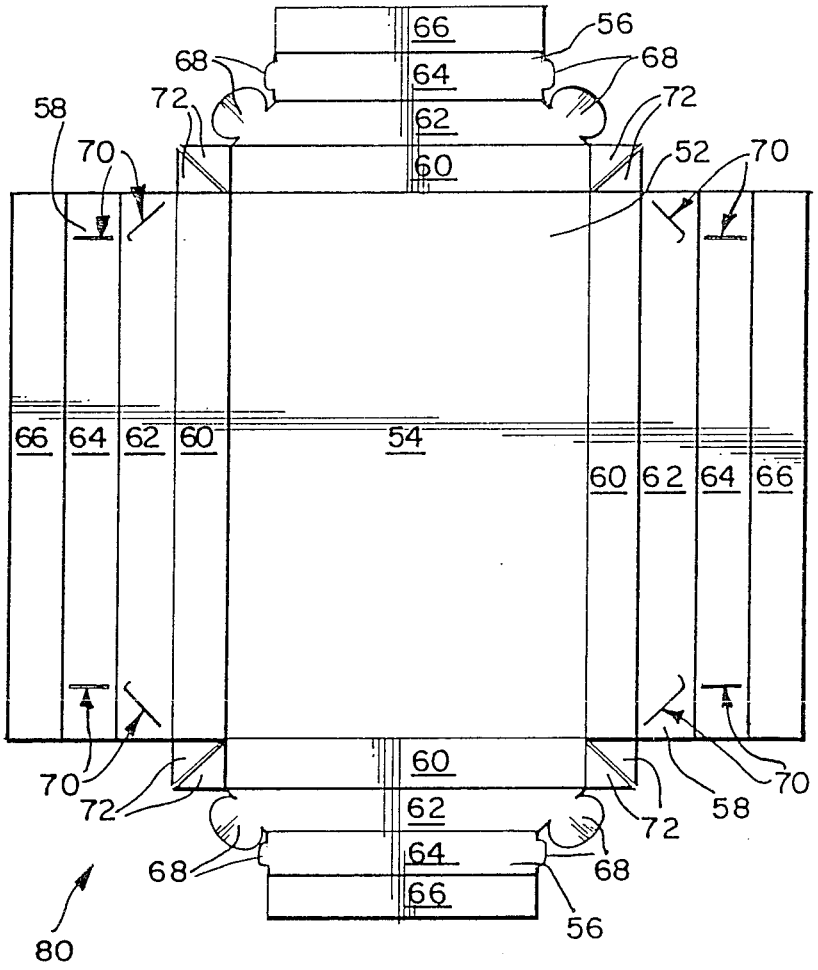
FIG. 6 shows a cardboard sheet element blank for forming a fourth embodiment of a picture support, in accordance with the invention.

The combination as anticipated is in fact illustrated in FIG. 6 of the drawing, with like parts and formations being indicated by the same reference numerals as used in FIGS. 3 and 5. As such, two sets of tongue formations 68 are provided, that project from the second and third flap portions 62 and 64 respectively of the flaps 56, as well as two sets of slits 70 defined in the corresponding flap portions of the flaps 58. With the tongue formations 68 and slits 70 all engaged as described above with reference to FIGS. 3 and 5, the flaps are effectively locked in position, providing a substantially rigid structure that does not require any adhesive or like means to further enhance the stability and rigidity of the picture support formed.

Still further, the blanks as above described can have a removable extension flap extending from one side thereof, the extension flap together with the remainder of the blank then being usable as a folder for carrying leaflets, or the like.

I claim:

1. A picture support for haging a picture on a wall, comprising a foldable sheet element having a rectangular central portion with first through fourth sides and having first through fourth flaps respectively connected to said first through fourth sides by respective fold lines, said first and third flaps extending from one pair of opposing sides and said second and fourth flaps extending from the other pair of opposing sides of said central portion, each of said flaps comprising:

a first flap portion connected directly to the corresponding side of said central portion and extending substantially perpendicular to said central portion when said sheet element is in a folded state;

a second flap portion connected directly to said first flap portion and extending substantially parallel to a front face of said central portion and substantially perpendicular to said first flap portion when said sheet element is in said folded state;

a third flap portion connected directly to said second flap portion and extending toward a rear face of said central portion and substantially perpendicular to said second flap portion and to said central portion when said sheet element is in said folded state; and a fourth flap portion connected directly to said third flap portion and extending toward a corresponding side edge of said central portion and substantially parallel to and in abutment with said rear face of said central portion when said sheet element is in said folded state;

wherein said flaps are suitably formed to avoid interference with one another when said sheet element is in said folded state and comprise interlocking means for interlocking certain flap portions when said sheet element is in said folded state, said interlocking means in turn comprising first through fourth pairs of tongue means respectively extending from opposite ends of said second and third flap portions of said first and third flaps and first through fourth pairs of slit means respectively formed in said second and third flap portions of said second and fourth flaps, said tongue means and slit means being arranged whereby each of said tongue means interlocks a respective one of said slit means, whereby said picture support is held in a box-like configuration.

2. A picture support as claimed in claim 1, in which the sheet element is of a suitable cardboard material that permits folding to provide for the required box-like construction.

3. A picture support as claimed in claim 1, in which the picture supporting central portion has a picture directly applied thereto.

4. A picture support as claimed in claim 3, in which the picture supporting central portion has a picture directly printed thereon.

5. A picture support as claimed in claim 1, in wihch the picture supporting central portion has a picture indirectly applied thereto.

6. A picture support as claimed in claim 5, in which the picture supporting central portion has a picture, already applied onto a sheet element such as paper, adhered thereto.

7. A picture support as claimed in claim 1 in which, the flaps have additional flap portions extending therefrom that can be folded to overlap with other flap portions in order to enhance the overall rigidity of the picture support in its operative configuration.

8. A picture support as claimed in claim 1, which has been formed of a planar cardboard blank being suitably cut-away to define the central portion and the flaps projecting therefrom.

9. A picture support as claimed in claim 8, which has been formed of a blank having fold lines that can facilitate folding of the flaps into their required configuration.

10. A picture support as claimed in claim 1, in which the central portion of the sheet element has poster pictures directly applied thereto.

11. A picture support as claimed in claim 1, which includes hanging means for hanging the picture support onto a wall.

12. A picture support as claimed in claim 11, in which the hanging means include an aperture formed within a flap that can engage a suspension means such as a nail extending from a support wall.

13. A blank for a picture support comprising a foldable sheet element having a rectangular central portion with first through fourth sides and having first through fourth flaps respectively connected to said first through fourth sides by respective fold lines, said first and third flaps extending from one pair of opposing sides and said second and fourth flaps extending from the other pair of opposing sides of said central portion, each of said flaps comprising:

a first flap portion connected to the corresponding side of said central portion by a fold line;

a second flap portion connected to said first flap portion by a fold line;

a third flap portion connected to said second flap portion by a fold line; and a fourth flap portion connected to said third flap portion by a fold line, wherein said flaps are suitably formed to avoid interference with one another when said sheet element is in a folded state and comprise interlocking means for interlocking certain flap portions when said sheet element is in said folded state, said interlocking means in turn comprising first through fourth pairs of tongue means respectively extending from opposite ends of said second and third flap portions of said first and third flaps and first through fourth pairs of slit means respectively formed in said second and third flap portions of said second and fourth flaps, said tongue means and slit means being arranged whereby each of said tongue means interlocks a respective one of said slit means when said sheet element is in a folded state.

14. A poster comprising a poster picture applied to a foldable sheet element having a rectangular central portion with first through fourth sides nad having first through fourth flaps respectively connected to said first through fourth sides by respective fold lines, said first and third flaps extending from one pair of opposing sides and said second and fourth flaps extending from the other pair of opposing sides of said central portion, each of said flaps comprising:

a first flap portion connected directly to the corresponding side of said central portion and extending substantially perpendicular to said central portion when said sheet element is in a folded state;

a second flap portion connected directly to said first flap portion and extending substantially parallel to a front face of said central portion and substantially perpendicular to said first flap portion when said sheet element is in said folded state;

a third flap portion connected directly to said second flap portion and extending toward a rear face of said central portion and substantially perpendicular to said second flap portion and to said central portion when said sheet element is in said folded state; and a fourth flap portion connected directly to said third flap portion and extending toward a corresponding side edge of said central portion and substantially parallel to and in abutment with said rear face of said central portion when said sheet element is in said folded state;

wherein said flaps are suitably formed to avoid interference with one another when said sheet element is in said folded state and comprise interlocking means for interlocking certain flap portions when said sheet element is in said folded state, said interlocking means in turn comprising first through fourth pairs of tongue means respectively extending from opposite ends of said second and third flap portions of said first and third flaps and first through fourth pairs of slit means respectively formed in said second and third flap portions of said second and fourth flaps, said tongue means and slit means being arranged whereby each of said tongue means interlocks a respective one of said slit means, whereby said poster is held in a box-like configuration.

* * * * *